1/22/85 XR 4,495,239

United States Patent [19]

Pusch et al.

[11] Patent Number: 4,495,239

[45] Date of Patent: Jan. 22, 1985

[54] CAMOUFLAGE MATERIALS HAVING A WIDE-BAND EFFECT AND SYSTEM INCORPORATING SAME

[76] Inventors: Gunter Pusch, Bannholzweg 12, 6903 Neckargemund 2; Alexander Hoffmann, Heidelberger Str. 24, 6901 Mauer; Dieter E. Aisslinger, Heidestr. 54, 6222 Geisenheim, all of Fed. Rep. of Germany

[21] Appl. No.: 459,354

[22] Filed: Dec. 16, 1982

Related U.S. Application Data

[63] Continuation-in-part of Ser. No. 226,787, Jan. 21, 1981, , which is a continuation of Ser. No. 942,703, Aug. 23, 1978, abandoned.

[30] Foreign Application Priority Data

Nov. 1, 1977 [DE] Fed. Rep. of Germany ..... 2750919

[51] Int. Cl.[3] ..... B32B 23/02

[52] U.S. Cl. ..... 428/192; 428/193; 428/195; 428/207; 428/247; 428/252; 428/263; 428/265; 428/919; 428/938

[58] Field of Search ..... 428/246, 247, 252, 260, 428/262, 263, 265, 919, 192, 193, 195, 207, 938

[56] References Cited

U.S. PATENT DOCUMENTS

| | | | |
|---|---|---|---|
| 2,349,993 | 5/1944 | Schimmer et al. | 428/919 |
| 3,427,619 | 2/1969 | Wesch et al. | 343/18 A |
| 4,001,827 | 1/1977 | Wallin et al. | 343/18 A |
| 4,064,305 | 12/1977 | Wallin | 428/246 |
| 4,289,677 | 9/1981 | Supcoe et al. | 428/919 |

FOREIGN PATENT DOCUMENTS

| | | |
|---|---|---|
| 1034070 | 7/1958 | Fed. Rep. of Germany . |
| 1035529 | 7/1958 | Fed. Rep. of Germany . |
| 1094163 | 12/1960 | Fed. Rep. of Germany . |
| 1840330 | 10/1961 | Fed. Rep. of Germany . |
| 1847355 | 11/1961 | Fed. Rep. of Germany . |
| 2056211 | 5/1971 | Fed. Rep. of Germany . |
| 977972 | 7/1974 | Fed. Rep. of Germany . |
| 2738188 | 4/1978 | Fed. Rep. of Germany . |
| 1124956 | 8/1968 | United Kingdom . |
| 1404121 | 8/1975 | United Kingdom . |
| 565238 | 11/1977 | United Kingdom . |
| 2001417 | 1/1979 | United Kingdom . |
| 2026660 | 7/1979 | United Kingdom . |

*Primary Examiner*—James J. Bell
*Attorney, Agent, or Firm*—Michael N. Meller

[57] ABSTRACT

A camouflage material with wide-band effect ranging from the visible portion of the spetrum, the IR region of the spectrum from 1 to 20 micrometers, as well as the radar region from 3 GHz to 3,000 GHz, consisting of at least a base layer with a vapor deposited metallic reflecting layer having a surface resistivity of 0.1 to 10 ohms per square and a camouflage paint layer applied thereon, the pigments of which have reflectivity that is similar, in the visible and near infrared portions of the spectrum, to that of the natural background, for example, to chlorophyll. In order to insure that such a camouflage material provides secure protection against detection by thermal imaging apparatus, even in the far IR region of the spectrum, without reducing the protective effect in the visible and near IR region of the terrestrial thermal radiation as well as in the radar region, the camouflage paint contains a binder that has good transparency in the spectral regions of the atmospheric windows II (3–5 μm) and III (8–14 μm). The camouflage material can be used for camouflage nets and thermal insulation mats which, together with means for providing removal of hot gases, can constitute a suitable camouflage system for military targets in which heat is produced by internal combustion engines.

17 Claims, 5 Drawing Figures

CAMOUFLAGE MATERIALS HAVING A WIDE-BAND EFFECT AND SYSTEM INCORPORATING SAME

BACKGROUND OF THE INVENTION

Cross Reference to Related Applications

This is a continuation-in-part application of application Ser. No. 226,787 filed Jan. 21, 1981, which is a continuation of application Ser. No. 942,703 filed Aug. 23, 1978, now abandoned.

Field of the Invention

The invention relates to camouflage materials having wide-band effects including the visible portion of the electromagnetic spectrum, the IR spectrum from 0.7 to 20 μm and also for the radar region of 3 GHz to 3000 GHz and to a system incorporating same which is especially suited for camouflaging military targets, including those in which heat is produced by internal combustion engines.

Description of the Prior Art

Previously available camouflage materials have covered only the visible and infrared range of the electromagnetic spectrum, or the visible, near infrared and radar ranges, but not all of these ranges in one material.

Known camouflage materials provide adequate protection in the visible and near-infrared spectral regions, by color adaptation to the background. However, present-day reconnaissance often employs thermal imaging devices or IR line scanning methods which operate in the far infrared region of the spectrum, namely in atmospheric windows II (3 to 5 μm) and atmospheric window III (8 to 14 μm). In other regions of the IR spectrum, the atmosphere is opaque for long distances. Currently used camouflage paints have an emission coefficient of approximately 95% in the far IR region of the spectrum. This, however, is independent of their color in the visible region. This emission coefficient is usually higher than the emission coefficient of the natural background. Accordingly, the known camouflage paints are able to be contrasted from the background in the far IR region of the spectrum and can be clearly detected by thermal imaging apparatus in the atmospheric windows II and III. In military targets in which heat is produced by internal combustion engines, there is also a temperature contrast between the target and its background in the range of heat radiation radiated by the target.

British Pat. No. 1,605,131, published Dec. 16, 1981, discloses a camouflaged object comprising a body having a surface which is highly reflecting in the spectral ranges 3 to 5 μm (window II) and 8 to 14 μm (window III) and a coating of a camouflage paint on the highly reflecting surface. The paint contains a pigment having camouflage properties in the visible and near IR range and a binding agent and has an emissivity less than 90% in the spectral ranges 3 to 5 μm and 8 to 14 μm. The emission power in windows II and III is "structured" by applying a priming paint comprising colors which are highly reflecting, in the manner of a clean metal surface, alternating with colors having a black effect in the long-wave IR range. "Structuring" may also be obtained by using a priming paint which is highly reflective and using a camouflage paint comprising pigments having different absorbing and/or scattering properties. A third method of "structuring" is obtained by using a primary paint which is highly reflecting and a camouflage paint with uniform pigmentation applied with locally different thicknesses. The binding agent suitably has a high absorption in the range from 5.5 to 7.5 μm. The patent also discloses the use of camouflage nets and thermal insulation mats treated in the same manner so as to be thermally structured.

U.S. Pat. No. 3,733,606 addresses the problem of detection by radar by using camouflage material consisting of a multi-layered material both absorbing and reflecting radar signals. At least one layer is a thin, non-homogenous electrically conducting film having a surface resistivity at radio frequencies exceeding 2000 MHz of between 100 and 1000 ohms but considerably different from 377 ohms, the characteristic impedance of free space, such as to establish reflection for at least 10% of the incident radar.

SUMMARY OF THE INVENTION

The object of the invention is to provide a camouflage material of the type described hereinabove which affords secure protection against thermal imaging apparatus in the far infrared region of the spectrum, without reducing effective protection in the visible and near-infrared regions of the spectrum.

A further objective of the invention is to provide protection against radar detection across the entire radar spectrum of 3 GHz to 3,000 GHz.

Another object of the invention is to provide a broad-band camouflage system for a stationary military target in which heat is produced by an internal combustion engine.

These objects are achieved, according to the invention, by providing a camouflage material which is reflective in the region of terrestrial thermal emissions in the form of a camouflage net which is fitted externally of the target and which is provided with slit garnishing material comprising a fabric upon which there are at least two layers, each of the said layers being effective as a camouflage for the target over an associated region of the electromagnetic spectrum different from the region associated with each other layer. More particularly such camouflage materials include of at least a base layer of material with a metallic reflecting layer thereon consisting of a conductive material such as aluminum, copper, zinc or alloys including such metals and a camouflage paint layer disposed thereon. The reflecting layer has a specific resistance not greater than about 0.5 to 10 ohms per square. The paint has an emissivity which varies over the surface of the material and varies between 50 and 90% in window II and between 60 and 95% in window III. The paint comprises pigments having reflection properties in the visible and near-infrared spectral regions that are similar to those of the natural background, for example of chlorophyll and a binder having good transparency in windows II and III and preferably high absorption emissivity in the spectral range from 5.5 to 7.5 μm. This reduces the emission contrast between the target and its natural background. A reduction in the temperature contrast between the target and its background in the range of heat radiation radiated by the target is effected by a thermal insulation mat which is provided under the camouflage net, and a further reduction in the temperature contrast is effected by means for causing additional cold air to flow-substantially laminarly-round and over hot gases produced by the internal combustion engine.

Preferably, the following three features are used for camouflaging military targets in the spectral ranges corresponding to the atmospheric windows in which transmission of a thermal picture is possible.

1. A reduction in the emission contrast between the target and its natural background by the use of camouflage nets which are provided with a garnishing material slit in known manner. The adaptation or structuring of the emission and reflectance of the IR radiation in the range of the above-mentioned atmospheric windows is effected by using a garnishing material which has a metallic infrared reflecting layer and over that an appropriate color coating (paint), for example as described in German Patent No. 27 00 202.

2. The temperature contrast between a hot or warm target and the natural background, which would permit detection from a large distance in the above-mentioned spectral range, is reduced by using thermal insulation mats, for example as described in German Offenlegungschrift No. 2 252 431, laid open May 2, 1974. These comprise a layer of heat insulating material, such as a foam material, and a reflecting layer, such as a metallized plastic film, separated by an air space of a few millimeters. As disclosed in Offenlegungschrift 20 16 404, laid open Jan. 20, 1977, the reflecting layer has a high reflectance in the range between 3 $\mu$m and 20 $\mu$m with a maximum between 8 $\mu$m and 12 $\mu$m.

3. In the case of military targets which constantly produce heat, this heat is extracted in the form of hot gases in order to reduce the temperature contrast. The hot exhaust gases are surrounded by a laminar flow of cold air in special air passages and are extracted from the camouflage construction. Heating of the structure and of the guide passages themselves is prevented, as disclosed, for example, in broad terms in British patent application No. 23674/78 by providing a bend in an outer tube carrying the cold air and which extends beyond a coaxial inner tube carrying the exhaust gases. This prevents the latter from hitting nearby objects and heating them up. The tubes are arranged so that the inner tube is obscured from view by the bend.

DETAILED DESCRIPTION

Figure 1:
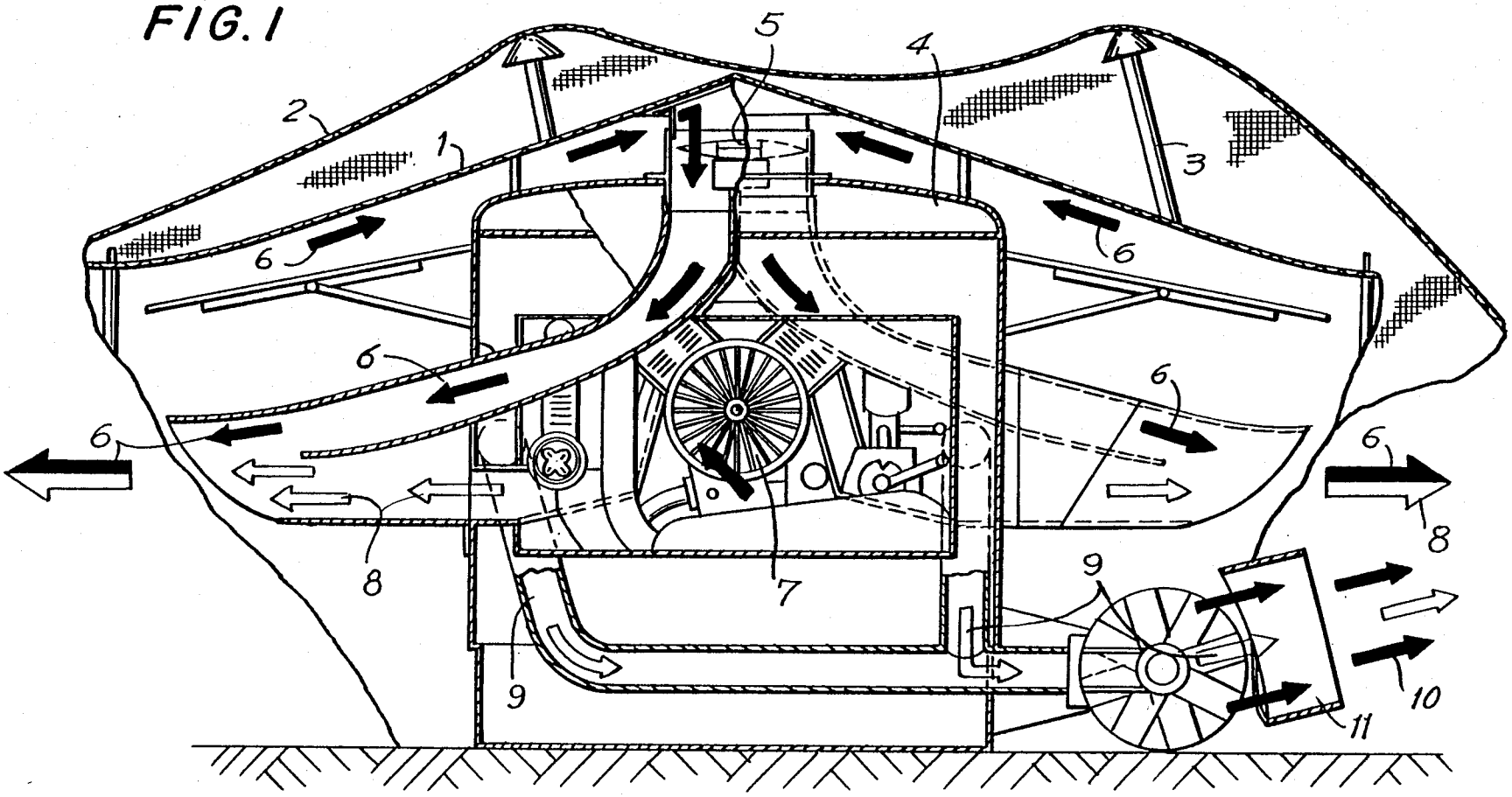
FIG. 1 is a schematic view of a camouflage system according to the invention, for a diesel electric generator.

Due to the structure of the camouflage material according to the invention, the emission coefficient can be adapted to the prevailing background without diminishing the reflective properties in the visible and near-infrared regions. This fact is based on the recognition, forming part of this invention, that the emission coefficient of a camouflage paint depends less on the pigments in the paint than on the binder being used. It has been found that some of the pigments, with the exception of the black pigment, have very low emission coefficients even though the emission coefficient of the camouflage paint containing these pigments remains high. This is due to the very high emission coefficients of the known binders, such as PV resins, in the atmospheric window II, and partly also in the window III, although not as markedly and these emission coefficients, vary from binder to binder.

If metallic objects, such as vehicles are painted with heretofore known camouflage paints, it can happen, when using certain binders, that the objects appear darker than the natural background through window II and brighter than the background through window III. Such vehicles are thus recognizable by means of thermal imaging apparatus.

This can be prevented when using the camouflage materials of this invention. Suitable binders that may be employed include cyclic rubber, butyl rubber, polyethylene, polyethylene-vinyl acetate copolymers and chlorinated polypropylene, the thermal transparency of these is known for the regions of interest in this application.

The base layer for camouflaging in the IR region having a wavelength of from 0.8 micrometers to approximately 20 micrometers is coated with a reflective metallic coating applied directly on the base layer, for example through vapor-deposition of aluminum. This achieves high reflectivities in the entire IR spectrum and in the radar regions. The protective effect against radar detection is achieved by incising the above described material so that it effectively reflects radar radiation in all directions. The reflective layer applied by vapor-redeposition has a resistance of approximately 0.5 to 10 ohms per square. The camouflage net then has a resistance of only a few ohms per square which corresponds to that of trees and bushes. Therefore, an object camouflaged with such nets, reflects radar emissions in the same way as do trees and cannot be distinguished from a corresponding background.

An example is provided by camouflaging a vehicle. When irradiated with radar emissions, every vehicle has a different reflection value from that of the corresponding background because it has large metallic surfaces and corners that cause a direct reflection to the point of observation. If such a vehicle is covered with a camouflage net according to the invention, it is no longer recognizable due to the reflective properties of the camouflage net. The observer can no longer distinguish the reflection coming from this location from those of the background (trees, bushes, etc.)

Objects provided with camouflage coverings are often subjected to varying environmental conditions, particularly regarding the type of background and the temperature of the objects as well as the background and the heat radiation impinging thereon. For this reason, a camouflage covering that is of maximum efficacy for a given set of environmental conditions need not be equally effective for other environmental conditions. To insure protection against detection by thermal imaging devices even under such circumstances, it is appropriate to structure the camouflage material with respect to its emission and re-emission in the atmospheric windows II and III, and in the visible part of the spectrum. This is known as mimicry. By so doing, the contour of the camouflaged object is so fragmented in the thermal domain that its geometric configuration is no longer discernible with the aid of thermal imaging apparatus. Moreover, one obtains a substantially complete adaptation to a thermally similarly structured background such as for instance bushes or trees.

The structuring of the camouflage material according to the invention may be obtained in several ways. For example, regions of the base layer can be made alternately reflecting and black absorbing in the long-wave IR spectrum (windows II and III), giving these partial regions different emission coefficients. In so doing, it is appropriate if the effectively black regions are covered up with camouflage paints that are effectively black or olive drab in the infrared region and that the reflecting partial regions are covered with camouflage paints that are transparent to infrared radiation, for example, green, brown or light gray paints. This avoids the possibility of negating the effects of the structuring of the base layer by unsuitable pigmentation of the camouflage paint. Examples of pigments which are suitable for this purpose are a mixture of chromium oxide green and 4-chloro-2-nitranilide yellow for olive drab, a mixture of azine black toner and toluidine red toner for black, chromium oxide for green, and titanium oxide mixed with black toner for gray.

The varied emissive structuring of the invention may also be obtained by utitizing a base layer that is made reflective over its entire area and applying thereto a pattern of camouflage paints whose pigments absorb and/or scatter radiation in varying degrees. In so doing, use is made of the fact that the pigments used in the camouflage paints have different properties of absorption and/or scattering in the IR region, depending upon their visible color and the particle size of the pigments.

Still another method of structuring is to make the base layer reflective over its entire area and to apply camouflage paint layers of different thicknesses, e.g. 10 to 50 microns in partial regions of the object. This kind of structuring is based on the fact that, in most cases, the emission coefficient depends on the thickness of the layer, i.e., on the number and size of the pigment particles embedded in the layer. The particle size of the pigments ranges from 1 to 3 microns.

The specific structuring of the camouflage layers, including pigments and binders may also be combined still further which broadens the range of adaptation to that of the prevailing background.

According to a further characteristic of the invention, the binder that is employed has high absorption and therefore high emissivity in the spectral region lying between the two windows II and III, i.e., in the region from 5.5 to 7.5 $\mu$m. As a consequence, an object that is covered with such a camouflage covering will emit some heat that it has developed in this spectral region. This emission cannot be detected, however, by thermal imaging apparatus, because the atmosphere is opaque in this region, at least over longer distances.

The camouflage materials according to the invention may be used, for example, for camouflage nets that are indistinguisable regarding their visible properties from those now in use. This is done by applying a first reflective base or metal coating to the textile garnishing of the camouflage net, whereafter the camouflage paint having the properties recited hereinabove is applied.

In contrast to camouflage nets now in use, such nets have a good camouflage effect even in the atmospheric windows II and III, especially if the camouflage coating is structured. Moreover, thermal insulation mats may be provided on their outside surface with the camouflage coating to diminish the temperature contrast and obtain the corresponding camouflage effect. The tendency of heat-insulating mats to become substantially hotter than their natural environment, due to solar irradiation and, thereby, to become detectable by thermal imaging apparatus as brightly-shining objects, can be prevented by covering the hot parts of the object to be camouflaged, which are encapsulated in the heat-insulating mats, with a camouflage net having the coating as described above at a distance that permits convective air circulation. As a consequence, the thermal contrast, i.e., the contrast of the hot parts of the object to be camouflaged relative to the natural background, is reduced by the presence of the heat-insulating mats and the overlying camouflage net prevents the solar radiation from heating up the insulating mats. The garnishing of the camouflage net, having crescent-shaped slits, when equipped with the structured camouflage coating according to the invention, is heated by solar radiation in the same manner as is natural foliage and is cooled by wind and/or air convection. The effect of the shading provided by the camouflage net is that the heat-insulating mats are heated up in a way that is no different from the natural surroundings.

The thermal structuring of the camouflage net, obtained by using the camouflage coating according to the invention, has the effect that the emission contrast of the net is non-uniform and differs from one place to the other. This causes the thermal structure of the entire camouflaged object to be so fractured that the geometrical configuration of the camouflage net is no longer recognizable by means of thermal imaging apparatus.

In the system of FIG. 1 a thermal insulation mat 1 is spread out a few decimeters above a diesel-electric generator 4, care being taken to ensure that air can circulate between the generator 4 and the mat 1. Laid over the thermal insulation mat 1 is a broad-band camouflage net 2, which is held at a distance of a few decimeters from the mat by supporting rods 3. The shadow which the broadband camouflage net 2 throws on the thermal insulation mat 1 prevents the mat from being heated, in the event of solar radiation, in relation to the natural environment which is cooled by wind and evaporation, with a strong temperature contrast resulting. The garnishing of the camouflage net 2 is formed with crescent-shaped slits in known manner so that the natural convection of air and wind ensures that it is largely adapted to the temperature of the environment.

The garnishing material, as shown in FIGS. 2, 3, 4 and 5 is constructed in the form of a multi-layer system. In this multi-layer system there are metallized layers 15 or metal layers 19 which cause reflection of incoming radar waves. The above-mentioned crescent-shaped slits or cuts ensure that the radar radiation is largely scattered during the reflection. For logistic and economic reasons, the same fabric is used as a base layer for the thermal insulation mat 1 and for the garnishing of the camouflage net 2. This fabric is preferably metallized on both sides and then provided with appropriate IR camouflage paints on one or both sides.

Figure 3:
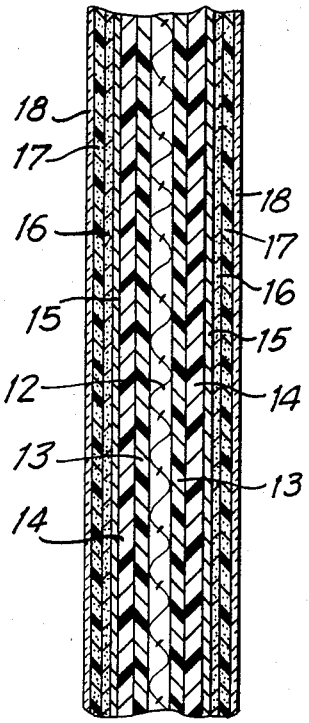
FIGS. 2 and 3 are partial cross-sectional views of various embodiments of camouflage nets according to the invention.
Figure 2:
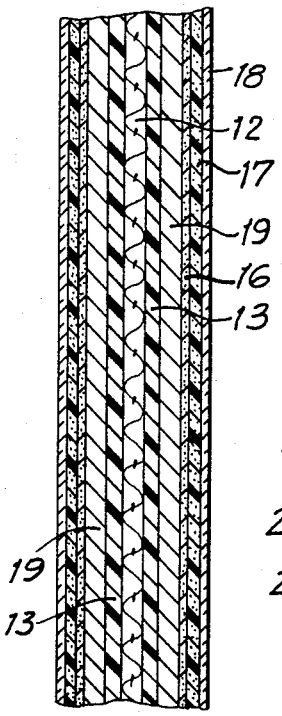

Referring to FIGS. 2 and 3, a textile fabric 12 which is a woven or non-woven material of 40 to 200 g/m$^2$ made of polyvinyl, polyamide, polyethylene, polypropylene or polyester fibers, preferably a polyamide, carries a coating 13 having a thickness of about 3 to 15 g/m$^2$, preferably of plasticized PVC, serves as a supporting base material. The plasticized PVC preferably consists of a blend of 1 part of poly (methacrylate) and 2 parts of a copolymer consisting of 86% vinyl chloride, 13% vinyl acetate and 1% maleic acid.

In FIG. 2 the plasticized PVC coating 13 on the fabric 12 is provided with a metallic layer 19 of aluminum, copper or zinc, preferably of aluminum, obtained by vapor deposition, preferably after causing the base material 12, 13 to pass through glow discharge in a low vacuum so as to remove volatile particles from the surface. The layer 19 is effective as a camouflage in the radar and long wavelength infrared regions of the electromagnetic spectrum.

In order to acquire a satisfactory bending and crease resistance, an alternative material, shown in FIG. 3 has a base material 12, 13 which is covered, preferably on both sides, with a plastic film 14, preferably polyester or vinyl, with a layer 15 of metal. Preferably a layer 15 of metal is vapor-deposited thereon. The thickness of this metal layer should amount to about 5 to 40, preferably 30 μm. A very thin layer (0.5 to 1 g/m$^2$) of an IR transparent primer coating 16, such as chlorinated polypropylene, especially formulated polyethylene or cyclic rubber in an aromatic or aliphatic solvent serves as a protective layer for the aluminum deposit and at the same time as a primer which improves the adhesion of a layer of camouflage paint 17 applied thereto. The paint 17 is effective as a camouflage in the visible and near infrared regions of the electromagnetic spectrum. The paint contains a pigment such as titanium dioxide, iron oxide, ultramarine blue, chromium oxide green or chromium oxide hydrate green. The latter three pigments have reflection characteristics similar to chlorophyll, and other specially treated pigments such as those sold by Ciba-Geigy under the name MIKROLIT. The pigment is ground with a binder, such as a polyethylene-vinyl acetate copolymer, and a solvent to obtain a particle size of 1 to 3 microns with a Gauss distribution. When a metallized plastic film is applied to the base layer, no plasticized PVC coating is used. Instead a polyurethane adhesive is used to adhere the film to the base layer.

The solvents used to prepare the solutions of the paints, coatings and binders used in the invention are preferably methyl ethyl ketone, methyl isobutyl ketone, ethyl acetate, toluene, xylene and blends thereof depending upon the type of application, i.e. spray coating, reverse coating, etc.

Figure 4:
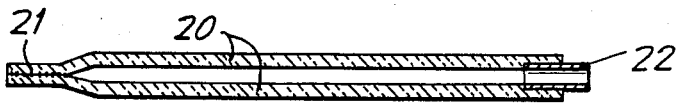
FIG. 4 is a schematic partial cross-sectional view of a laminated camouflage structure according to the invention which can be inflated.

The thermal insulation mats 1, which are provided to camouflage the temperature contrast between the warm or very hot generator and its background over the range of heat radiation radiated by the generator, in accordance with means 2, above, are made in the form shown in FIG. 4. The mats consist of two laminated sheets 20 of the type described above, which are sealed in an air-tight manner at an edge 21 and can be inflated through an aperture 22. The lamination glue or adhesive comprises 5 to 20 g/m$^2$ of highly chlorinated PVC or PVdC in the form of about a 50% water dispersion or about a 35% solution in a 1:1 blend of toluene and tetrahydrofuran. In the interior of this device, the inner surfaces of the sheets are not provided with camouflage paint so that they act as reflectors and largely prevent the transfer of heat through radiation. The intervening layer of air ensures that heat conduction is greatly reduced.

Figure 5:
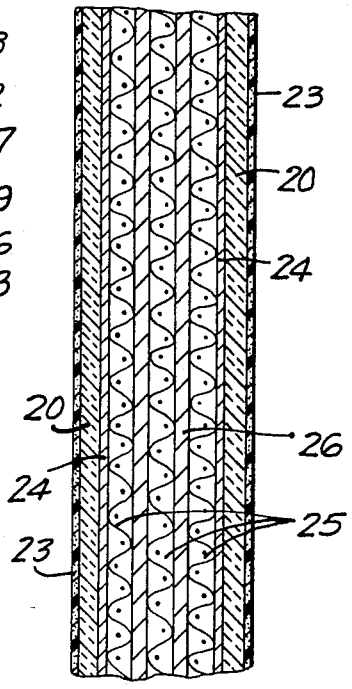
FIG. 5 is a partial cross-sectional view of one embodiment of a thermal mat according to the invention.

FIG. 5 shows a further improvement in a thermal insulation mat. In this mat, laminated sheets 20, e.g. having a structure as in FIGS. 2 and 3, are provided with camouflage paint 23 on their surfaces, as previously described, and have their inner surfaces 24 reflecting. Between the sheets 20 are nets 25, which ensure spacing and hence air insulation, and reflecting metallized films 26, which are metallized on both sides. They are protected from mechanical damage by the nets 25 and the stable outer skin 20 and can therefore be made a few microns thick.

Such multi-layer designs have the decisive advantage of achieving very high thermal insulation with minimum weight, both with respect to radiation and to convection, and so reduce the temperature contrast, which may amount to more than 100° C. between target and background, to only a few tenths of a degree Celsius.

Furthermore, it is preferable that the thermal insulation mats 1 are only applied to the parts of the objects to be camouflaged which have a comparatively high temperature contrast, that is to say, the surface temperature of which is more than 10° C. above that of the natural background.

This leads to the idea that thermal insulation mats 1 should have a geometric shape corresponding to that of the hot parts of the object to be camouflaged, for example the hood of a vehicle or the front of a tank, that is to say that they should be cut to size.

At least the side of the thermal insulation mat 1 adjacent to the object to be camouflaged is not provided with the usual camouflage paint, but with a paint which is transparent to infrared radiation, i.e. a thicker layer of IR transparent primer coating, to suppress heating by heat radiation from the beginning. The reflecting action of the metallizing is then fully retained.

Camouflage nets for camouflaging military targets from the visible to the radar range using garnishing material having crescent-shaped cuts and coated with camouflage paints containing pigments which have a reflection characteristic similar to chlorophyll in the visible and and near IR range, binding agents which have a satisfactory transparency in the ranges from 3–5 μm and 8–14 μm, and a base coat which is metallically reflecting, are particularly effective against radar reconnaissance, if the specific resistance of the reflecting layer amounts at a maximum to only a few ohms, that is between 0.5 and 10 ohms, which causes an extremely satisfactory reflection in comparison with the wave resistance of free space of 377 ohms. If the emission factor of the paints varies over the surface, for example between 50 and 90% in atmospheric window II (3 to 5 μm) and between 60–95% in window III (8–14 μm), such a net will fit excellently into the background under all atmospheric conditions.

A thin layer 18, effective as a camouflage in the ultraviolet region of the electromagnetic spectrum, is applied to the outermost layer 17 of paint of the camouflage net as shown in FIG. 3. The layer 18 is made transparent to all other spectral ranges and consists of a benzophenol derivative, preferably benzopyran, or a polyolefin resin. This is possible, for example, as a result of the fact that this layer 18 has an optical thickness of about λ 14 in the ultraviolet. Such a layer 18 acts as a barrier layer, but is transparent in the visible range and has no effect at all in the infrared range. In addition, the effect of this layer 18 can be further improved and adapted to the natural environment by incorporating substances known per se which absorb ultraviolet light.

If heat is constantly generated by an object to be camouflaged, it is not sufficient to reduce the temperature contrast by thermal insulation alone because any amount of heat may accumulate below the thermal insulation layer. Care must be taken to ensure that this heat is extracted from the camouflage construction in a manner which renders it invisible to infrared observation. Only gases which are present in the atmosphere can serve as heat carriers which are invisible to thermal-picture reconnaissance, because their characteristic radiation is again absorbed in the air. For example, if the internal combustion engine shown in FIG. 1 is cooled by a turbo-fan 7 and if the heated cooling air 8 is taken out of the camouflage structure, this air is not visible through the atmosphere because oxygen, nitrogen, water vapor and $CO_2$, the main components of the air, radiate outside the atmospheric windows because there the atmosphere has its strongest absorption, that is to say the exhaust air also has its strongest characteristic radiation when heated. Care must be taken to ensure, however, that this heated air 8 does not heat any solid objects such as conduits, thermal insulation mats, camouflage nets or trees standing in the vicinity because broadband heat radiation is emitted from these and is transmitted through the atmospheric window.

To this end, a stream of cold air 6 is spread over the warm air 8 and ensures that the parts of the exhaust-air conduits which could become visible from the outside remain cool. The warm exhaust air is forced out of the camouflage system through a covering envelope of cool air, which surrounds it in laminar flow, by means of the fan 5, the proportion of cool air ensuring that edges of the camouflage nets 2 and of the thermal insulating mats 1 also remain cooled.

The cold air 6, which is used for laminar flow around the hot gases, is drawn into the camouflage system so that an accumulation of warm air under the thermal insulation mat is reliably avoided. As a result, the convection transfer of the heat is considerably reduced and both the outer temperature of the generator housing 4 and also the inner temperature of the thermal insulation mat 1 is reduced.

The cooling of the exhaust pipe is effected, as already shown in British patent application No. 23674/78, by a laminar sheath 10 of cool air for the hot exhaust gases 9 which consist mainly of $CO_2$ and $H_2O$, that is to say gases which are present in the atmosphere. This selective radiation is therefore resonantly absorbed in the atmosphere. Since these exhaust pipes may heat hard objects in the environment, such as bushes, trees, etc. making these then appear brightly luminous in the thermal picture, the end of the conduit 11 which conveys the warm air surrounded by cold air, can always be directed into the open by turning and pivoting.

The following examples illustrate the preparation of specific embodiments of FIGS. 2–5.

EXAMPLE 1

A woven nylon textile material of about 60 g/m$^2$ was coated with about 15 g/m$^2$ of a plasticized polyvinyl chloride by spraying with a 20% solution in methyl ethyl ketone. After being allowed to dry the coated textile material was coated on both sides with 20 nanometers of pure aluminum by vapor deposition under vacuum. The metallized coating was treated with a 30% solution of chlorinated polypropylene to provide a primer coating of 0.5 g/m$^2$. After the primer coating was dried, a camouflage paint was applied. The paint contained chromium oxide green as a pigment in a polyethylene-vinyl acetate copolymer binder. The pigment and binder had previously been ground together until the average particle size of the pigment was about 1 to 3 microns. Such fine grinding obtains good reflectivity in the visible and near-infrared, with good transparency, thus low absorption/emissivity in the far infrared. After the paint was dry, a final protective coating of polyolefin resin was applied by spraying from a 20% solution in methyl ethyl ketone. The product had the structure of FIG. 2.

EXAMPLE 2

A non-woven polyethylene fabric 12 of about 45 g/m$^2$ was coated with a polyurethane adhesive 13 and a polyester film 14, previously coated with 30 nanometers of aluminum 15 by vapor deposition, was applied by rolling. Then the metallized film surface was coated with 1 g/m$^2$ of a primer 16 consisting of cyclic rubber from a 15% toluene solution. After drying, a camouflage paint 17 was applied in random thickness. The paint contained a mixture of chromium oxide green and 4-chlor-2-nitranilide yellow; azine black toner and toluidine red toner; and ultramarine 2 toner with a particle size of about 1 to 3 microns applied in a conventional camouflage pattern of olive drab, black and blue areas. The binder was a copolymer of polyethylene and vinyl acetate which had been previously ground with the pigment. The final protective coating 18 was the same as in Ex. 1. The final product had the structure of FIG. 3.

EXAMPLE 3

A laminated structure as in FIG. 4 was prepared from two sheets made as in Ex. 1 by gluing with 10 g/m$^2$ of polyvinyl chloride using a 50% aqueous dispersion containing 10% antimony oxide as a flame retarder.

EXAMPLE 4

A laminated structure as in FIG. 5 was made from two sheets of material 20 as prepared in Ex. 2. The metallized polyester films 26 were metallized as in Ex. 2 except on both sides. These were glued to supporting polyester nets 25 using a polyvinylidene chloride adhesive in a 35% solution of toluene: tetrahydrofuran in a 1:1 ratio. The outer layers consisted of the sheets 20 coated with a camouflage paint 23 on the outside and a vapor deposited aluminum coating 24 on the inside next to the polyester net 25.

While this invention has been illustrated and described in connection with certain preferred embodiments thereof, it will be apparent to those skilled in the art that the invention is not limited thereto. Accordingly, it is intended that the appended claims cover all modifications which are within the true spirit and scope of the invention.

We claim:

1. A camouflage material having a wide-band effect ranging from the visual portion of the spectrum up through the radar region of the spectrum, said material comprising at least a base layer, a homogenous metal layer on said base layer reflective in the range of terrestrial thermal radiation as well as in the radar region of the spectrum and having a specific surface resistivity of not more than 0.5 to 10 ohms per square and a camouflage paint applied on said reflective metal layer, said paint containing pigments having reflective properties in the visible and near IR spectral regions that are similar to the natural background and containing a binder having high transparency characteristics in the spectral regions of the atmospheric windows II (3–5 $\mu$m) and III (8–14 $\mu$m) and wherein the emissivity of the camouflage paint in windows II and III varies over the surface of the material and varies between 50 and 90% in window II and between 60 and 95% in window III and wherein the metal is selected from the group consisting of aluminum, copper, zinc and its alloys.

2. The camouflage material according to claim 1, wherein said reflective metal layer consists of a homogeneous, conductive coating of aluminum produced by vapor deposition.

3. The camouflage material as in claim 1, wherein the binder of the camouflage paint has high absorption-/emissivity in the range from 5.5 to 7.5 μm.

4. The camouflage material as in claim 3, wherein the paint binder is a polyethylene-vinyl acetate copolymer.

5. The camouflage material according to claim 1, wherein the base layer contains partial zones which are alternatingly reflective and effectively black in the long-wave region of the IR spectrum.

6. The camouflage material according to claim 5, wherein camouflage paints that are effectively black or olive-green are applied over the effectively black zones of the base layer and camouflage paints that are transparent to infrared radiation in the visible region are applied over the reflecting partial zones of the base layer.

7. The camouflage material as in claim 1, wherein the reflective coating on the base layer is reflective over its entire areal extent and wherein, in partial zones of the reflecting layer, the camouflage paint contains pigments with different properties of absorption and/or scattering.

8. The camouflage material as in claim 1, wherein the reflective coating on the base layer is reflective over its entire areal extent and wherein, in partial zones of the reflecting layer, the camouflage paint is applied with different thicknesses.

9. The camouflage material as in claim 1, wherein the outer surface of said material is covered with a thin layer of a compound which acts as a camouflage in the ultraviolet range, but is transparent in the visible and IR range.

10. The camouflage material as in claim 9, wherein said compound is selected from the group consisting of polyolefin resins and benzopyran.

11. The camouflage material as in claim 1, wherein said base layer is a textile fabric coated on each side with a plastic material.

12. The camouflage material as in claim 11, wherein said textile material is selected from the group consisting of polyvinyl, polyamide, polyethylene, polypropylene and polyester material.

13. A thermal insulation mat comprising two sheets of a camouflage material having a wide-band effect ranging from the visible portion of the spectrum up to the radar portion of the spectrum, said material having a metal layer which is reflective in the range of terrestrial thermal radiation and a camouflage paint applied on said reflective layer, said paint containing pigments having reflective properties in the visible and near IR spectral regions that are similar to the natural background, the sheets being joined together along one edge of each sheet and being arranged so that one overlies the other and the said camouflage paint being applied to an outer surface only of each sheet.

14. The thermal insulation mat as in claim 13, wherein each sheet further comprises a metallized plastic film and a textile fabric net intermediate the metallized plastics film and the said base layer.

15. The thermal insulation mat as in claim 13, wherein the sheets are joined together by an air-tight weld, and an opening is provided between the sheets whereby the mat can be inflated.

16. The thermal insulation mat as in claim 15, wherein each sheet further comprises a metallized plastics film, and a textile fabric net intermediate the metallized plastics film and the said base layer.

17. The thermal insulation mat of claim 13, wherein said reflective layer comprises a homogeneous, metal layer having a specific resistivity of not more than 0.5 to 10 ohms per square, wherein said paint contains a binder having high transparency characteristics in the spectral regions of the atmospheric windows II (3–5 μm) and III (8–14 μm), wherein the emissivity of the camouflage paint in windows II and III varies over the surface of the material and varies between 50 and 90% in window II and between 60 and 95% in window III, and wherein the metal is selected from the group consisting of aluminum, copper and zinc.

* * * * *